United States Patent [19]

Zimmermann

[11] 3,938,914

[45] Feb. 17, 1976

[54] PUMP IMPELLER AND COUPLING MAGNET STRUCTURES

[75] Inventor: Frederick N. Zimmermann, Deerfield, Ill.

[73] Assignee: March Manufacturing Company, Glenview, Ill.

[22] Filed: Aug. 18, 1969

[21] Appl. No.: 854,019

Related U.S. Application Data

[63] Continuation of Ser. No. 679,777, Nov. 1, 1967, abandoned.

[52] U.S. Cl. ..... 417/420; 310/104

[51] Int. Cl. ..... F04b 17/00; F04b 35/04

[58] Field of Search..... 103/87, 87 M; 230/15 MC; 310/104, 156; 64/28 M; 192/84 PM; 417/420

[56] References Cited

UNITED STATES PATENTS

| | | | |
|---|---|---|---|
| 2,350,534 | 6/1944 | Rosinger | 103/87 UX |
| 2,555,686 | 6/1951 | Farrelly et al. | 103/6 X |
| 2,970,548 | 2/1961 | Berner | 103/87 |
| 3,181,018 | 4/1965 | Shafranek et al. | 310/156 |
| 3,205,827 | 9/1965 | Zimmermann | 103/87 |
| 3,411,450 | 11/1968 | Clifton | 103/87 |

*Primary Examiner*—William L. Freeh
*Attorney, Agent, or Firm*—Callard Livingston

[57] ABSTRACT

Cylindrical impeller-coupling magnets of the ceramic type in magnetically-coupled centrifugal pumps according to the disclosure are encircled by guard banding to aid in retaining the cylindrical configuration in cases of cracking and fissuring in the magnet body occasioned by exposure to superheated liquids in the impeller chamber. Supplements to the subject: the banding may be characterized as (1) non-metallic or metallic and non-magnetic; (2) multiple narrow bands or a single wide banding embracing the cylindrical aspect of the magnet in its entirety; (3) the cylindrical aspect of a cup-shaped metallic jacket with a bottom portion additionally shielding one axial end of the magnet; (4) the cylindrical aspect of a totally-enclosing encasement; (5) of thin cross section to lie upon the cylindrical surface (6) of moderately thick ring-like stock seating in recessing grooves in the cylindrical surface; (7) in all forms constrained against projection more than slightly into the magnetic air gap.

18 Claims, 8 Drawing Figures

PUMP IMPELLER AND COUPLING MAGNET STRUCTURES

This application is a continuation of my application Ser. No. 679,777, filed Nov. 1, 1967, and now abandoned in favor of the instant application.

The invention provides means for guarding against the jamming of impellers equipped with cylindrical coupling magnets of the ceramic type in magnetically-coupled centrifugal pumps wherein the impeller is rotated by an external motor impositively coupled therewith through the interaction of the magnetic flux of respectively internally and externally situated magnets, the inner one of which is affixed to the pump impeller, and the external one of which is rotated outside of the pump body in a path closely about the internal magnet.

Permanent magnets suitable for use in coupling arrangements of the class described are usually formed of pressure-molded magnetic compositions of the class of barium ferrite, and are sometimes characterized as "ceramic" magnets, in contradistinction to the essentially metallic ferrous magnetic materials, alloys and compositions containing nickel and like metals in combination with iron.

Cylindrical impeller magnets of the ceramic type are found to develop cracks and fissures as the result of exposure to very hot liquids traversing the impeller chamber, as a result of which the closely dimensioned cylindrical configuration of the magnet may change; and if there is any deformation in the direction radial to its axis so that even a small part projects into the narrow magnetic air gap subjoining the cylindrical surface of the magnet, which must rotate in very close proximity to the wall of the housing surrounding it, the impeller can easily be stopped with no indication of the stoppage, however, readily perceptible from any observation of the driving motor and external coupling magnet, which will continue to rotate, notwithstanding. Possible shifting of a fragmented portion of the internal magnet in an axial direction, however, does not present the same degree of danger because the impeller and its magnet are intentially designed to be shiftable limited amounts along the spindle, whereas, the air-gap requirements for the most efficient magnetic coupling are such as to allow only a very narrow tolerance for clearance between the cylindrical periphery of the magnet and the surrounding chamber wall, which may be of the order of 0.025 inch. Thus, it will be appreciated that a very slight projection of only a small portion of the magnet in a radial sense toward the air gap can bridge the clearance and impinge against the chamber wall with the consequences alluded to, as there is little margin afforded by the magnetic coupling forces for overload without slippage. Normally, this characteristic of magnetic coupling may be considered advantageous, over and above its other advantages in eliminating the passage of any driving shaft through the pump housing; but under the special jamming condition which may arise from a cracked magnet there is the danger that the pump failure can only be detected by observation of the flow in the pump line, or signals afforded by special monitoring equipment provided for the purpose.

The use of impeller magnet assemblies such as herein disclosed sufficiently guards against or reduces the incidence of pump failure from the causes alluded to, to obviate the expense of monitoring equipment and eliminate a great deal of down-time, and possibly serious damage which can arise in certain chemical processes, dependently upon the extent of the cylindrical surface encompassed and degree of containment of the entire magnet body, as will appear more fully from the following detailed description of the preferred embodiments of the invention considered in view of the annexed drawing in which:

Figure 1:
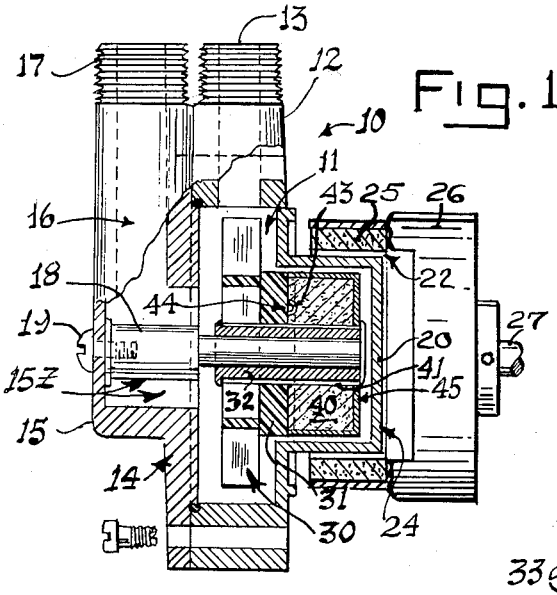
FIG. 1 is a cross section through a magnetically coupled pump with parts shown in elevation.

For purposes of illustration, the improvements are described in conjunction with the impeller employed in a magentically coupled pump such as depicted in FIG. 1, comprising a metallic housing or body casting 10 providing an impeller chamber 11 into which communicates a discharge duct 12 terminating in a threaded coupling nipple 13, such chamber having an open side normally sealed off by a closure casting 14 having formed as an integral protuberance on the outer wall thereof, an inlet chamber 15 into which communicates an inlet duct 16 terminating in another coupling nipple 17.

One end of a cantilever-supported or single-ended spindle 18 is footed in a low-pressure zone, generally indicated at 15Z defined within the special inlet chamber 15, the spindle being secured by means such as the screw 19, and projecting into space across the inlet chamber, into and beyond the impeller chamber 11, and thence into a coaxially extending magnet well 20, formed as an integral protuberance projecting axially away from the closure casting 14. The external aspect of the magnet well is adapted to fit freely but closely and coaxially within the bore 24 of an external driving magnet 25 secured in a carrier 26 upon a motor shaft 27 for rotation thereby.

Figure 3:
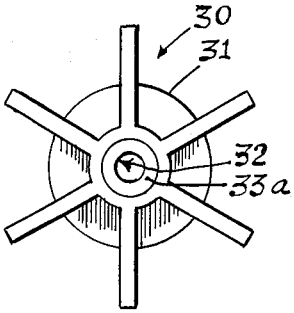
FIG. 3 is an elevational view of the impeller seen from the axial end thereof appearing in FIG. 2.

Rotatably mounted on the spindle 18 is a pump impeller 30 having a hub portion 31 penetrated by a bushing 32 fitting onto the spindle. A driven impeller-coupling magnet 40 of cylindrical shape provided with a bore 41 fitting upon the bushing 32, is secured in assembly with the impeller by staking or peening the ends **33*a* (FIG. 3) and 33*b*** (FIG. 4) of the bushing.

Figure 2:
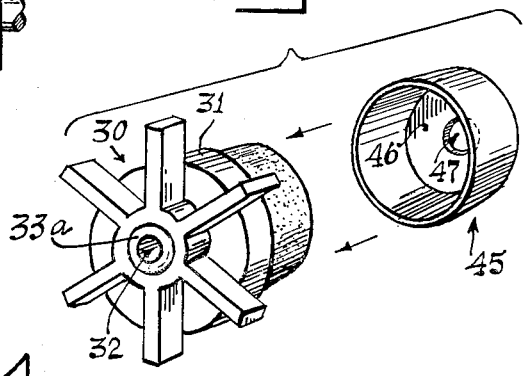
FIG. 2 is an exploded perspective detail of the impeller and magnet guard means employed in the embodiment of FIG. 1.
Figure 4:
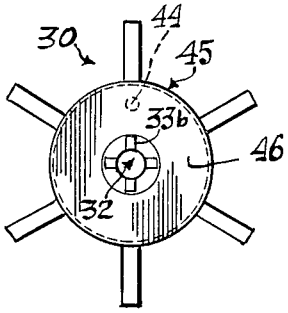
FIG. 4 is an elevational view of the impeller and its coupling magnet, viewed from the axial end opposite that seen in FIG. 3.

Guard means, having a wide cylindrical wall adapted to encircle the entire cylindrical aspect, and one axial end of the driven magnet (distal from the hub), comprises a cup-shaped enclosure or jacket member 45 (FIG. 2 also) of stainless steel of the non-magnetic type, dimensioned to fit closely onto the magnet body and embrace the entire cylindrical aspect and one axial end thereof. As seen in FIGS. 2 and 4, the bottom wall 46 of the cup-shaped jacketing means is provided with a hole 47 through which the appertaining end 33*b* of the bushing protrudes slightly for staking or peening, as aforesaid.

The wall thickness of the jacketing guard member 45 is desirably kept as thin as possible in respect to the width of the magnetic air gap, as will more fully appear, and in any case will project only minimally into such gap beyond the cylindrical periphery of the magnet body. Whether or not the attachment of the magnet in the impeller assembly is augmented by cementing, it is preferred to key these parts together by means such as boss 44 (FIGS. 1 and 4) projecting axially from the impeller hub into a keying dimple or depression 43 formed in the confronting axial end of the magent.

The described impeller assembly when mounted on the spindle 18, as in FIG. 1, disposes the driven magnet 40 substantially within the magnet well 20 and accordingly within the circumscribing ambit of the bore 24 of the outer driving magnet. The space at 22 between the subjacent peripheries of these magnets, constituting the magnetic air gap across which the magnetic lines of force interact in the coupling function, is kept quite narrow, it being necessary accordingly that the thickness of the wall of the magnet well (exaggerated slightly for clarity) which will lie in such air gap, be likewise kept as thin as feasible to afford a maximum safe clearance for free rotation of the coupled magnets. In such an environment, it will be evident that a modest shifting of a part of the magnet 40 into the air gap could readily jam the magnet and hence the impeller. Such a condition would stop the impeller but not the external magnet because of the slippage possible across the magnetic coupling fields. The guard jacket 45 eliminates the possibility of such shifting and stoppage, should a fracture lead to fragmentation or deformation, or dislocation.

In effect, the cylindrical wall of the cup-shaped stainless steel jacket 45 of FIG. 2, affords a single encircling band wide enough to embrace the entire cylindrical periphery of the magnet; and apart from the additional containment and shielding afforded by the appendant bottom-wall portion 46 of such a banding means, there is the advantage that the entire jacket is further secured in the assembly by the peened end 33*b* of the bushing 32 against such bottom portion. This is of significance for the reason that the wall thickness of the jacket must be kept minimal, and if a press fit alone is relied upon to hold the jacket in place (e.g., without cement, which may also seal off the magnet against chemical action), the press fit should not over-stress the band, and accordingly the further securing of the bottom by engagement of the headed or staked bushing therewith permits only moderate reliance upon the press fit, and or bonding or sealing cement in the case of chemically sealed magnets, FIGS. 1 and 5.

Because of material, fabrication, and assembly costs, the non-magnetic stainless steel jacketing embodiment of FIGS. 1 to 4 has been found to be economically suited mainly to smaller impeller assemblies in which the axial length of the magnet does not much exceed one and one-quarter inches in relation to a diameter of about the same proportions.

Figure 6:
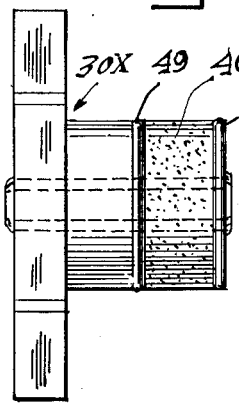
FIG. 6 is a side elevation of an impeller and appertaining coupling magnet equipped with another modification of the guard means.
Figure 7:
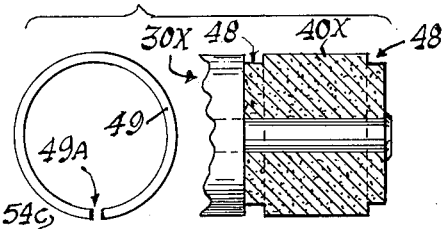
FIG. 7 is a composite elevation and fragmentary sectional detail of parts of a modified form of guard means and the appertaining impeller magnet.
Figure 8:
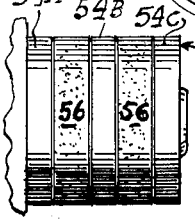
FIG. 8 is a fragmentary elevational detail of an impeller and appertaining coupling magnet embodying another modified form of the guard means.

For impeller structures having magnets of larger size, the modified multiple-banding embodiments of FIGS. 6 to 8 are found more economical and suitably effective in those applications which do not require the magnet to be completely enveloped as a protection against chemical action.

As seen in FIGS. 6 and 7, the inner coupling magent 40X may be joined in assembly with its impeller 30X in the same manner as described in view of FIGS. 1 to 4; but in this modification circumferential grooves 48 are provided at effective locations along the cylinder axis, for example at both axial ends, affording recessive seats into which metal clamp rings 49, of moderate stiffness and having a narrow split as at 49A to yield in slight spreading action, are sprung to seize the magnet body firmly in a substantially encircling grip preventing radial displacement of sections fracturing along generally axially-oriented fault lines.

The guard bands 49 may be of stiff wire stock having a round cross section. The diametric dimension (i.e., radially of the axis of rotation of the magnet cylinder) is such as to assure that the outermost margins of the rings do not stand out of their grooves appreciably into the air gap zone beyond the cylindrical boundry of the magnet.

While the aforesaid multiple-banding embodiment utilizes only two clamping rings, additional rings may be supplied at positions inwardly of the endwise rings 49 described.

Thus, in accordance with the multiple-band modification of FIG. 8, which is adapted to use with larger magnets, a greater portion of the cylindrical surface area of the magnet 50 may be encompassed along axially spaced zones by encircling bands 54A, 54B, 54C of stainless steel, preferably of the non-magnetic type, one of which is disposed at each of the axial ends of the magnet, as at 54A and 54C, with another situated in the mid-region therebetween, as at 54B.

Thus, the flat bands 54A, B, C as applied in a construction such as shown in FIG. 8, may leave greater or less portions of the magnet periphery exposed in the circumferential zones 56 intervening therebetween, depending upon the width of each band; and in this connection, it will be understood that such flat bands need not all be of the same width, nor limited to the multiple of three.

The greater width of the multiple-band guard means of FIG. 8, as compared with the construction of FIGS. 6 and 7, permits the use of thinner metal stock, comparable to the wall thickness of the metallic jacket 45, contemplated by the construction of FIG. 1, which has been shown at a slightly exaggerated scale for clarity of illustration, but which in practice may be of the order of 0.005 inches in both the single-band (FIG. 1) and multiple-band embodiments (FIG. 8), such thickness making it unnecessary to provide grooves in the cylinder wall to reduce air-gap entry, since the extent to which the thin wide bands lie in the air gap are within the clearance limits, affording assured clearance for rotation of the magnet.

In the case of pumps required to handle chemicals or which may be susceptible to contamination, or have a corrosive or other reactive effect with the metals ordinarily used to cast pump bodies, the pump components, including body, spindle and impeller may be formed of synthetic plastic materials, for example, polypropylene, in accordance with the impellers in the disclosures in my copending application Ser. No. 584,171; and in many cases the impeller of such pumps may be usable with the stainless steel jacket means 45 encasing the coupling magnet in conjunction with suite able adhesives or cements wholly sealing off the juncture between the proximate end of the magnet and the impeller hub, so as to afford a non-reactive or non-contaminative structure for the intended application of the pump, the bushing being of a metal likewise compatible to such application, or being omitted altogether, and replaced, where necessary, by a plastic lining interiorly of the magnet bore.

Figure 5:
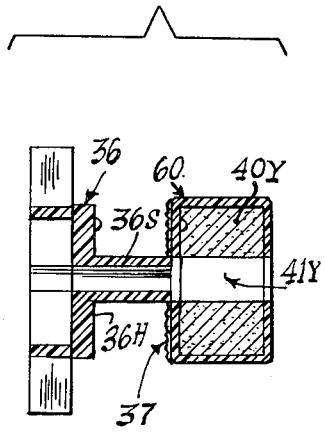
FIG. 5 is a cross-sectional detail, with parts shown in elevation, of an impeller and coupling magnet embodying a modified form of magnet guard means, the parts being shown separated.

In the event that the chemical nature of the liquid pumped will permit of no exposed metal-bearing materials whatsoever, including any metal bushing or portion of the magnet, the modified plastic magnet guard means of FIG. 5 may be employed, in accordance with which the magnet 40Y is wholly enveloped in its external aspects by a cylindrical encasement 60 of plastic, such as polypropylene or polyethylene. The spindle bore 41Y in the magnet in this embodiment is closely fitted onto a stud-shaft 36S which is an integral part of the hub 36H of the plastic impeller 36, a suitable cementitious coating, indicated at 37, being applied between the impeller hub and the proximate end of the magnet encasement on the one hand, and the bore of the magnet and the plastic impeller stud shaft on the other, whereby the magnet is effectively encased within a non-metallic envelope which is substantially immune to chemical attack.

In order to procure a cylindrical wall of uniformly thin minimal thickness in the production of impeller structures, according to the embodiment of FIG. 5, it is preferred to have at least the cylindrical wall section of the plastic envelope overly thick initially and then machine the surface thereof down to the requisite clearance thickness for the particular air gap clearance involved.

In respect to the metallic forms of the guard banding, it will be understood that metals other than stainless steel of the non-magnetic variety may be employed, brass for example, provided such metal is compatible with the fluid to be pumped; but, in general, stainless steel can be used in the presence of so many liquids other than water, that it is preferable in the non-magnetic varieties for general application.

Insofar as the metallic banding is alluded to as "non-magnetic," it is known that some grades of non-magnetic stainless steel become slightly magnetic as the result of machining and similar working, particularly in thin sections for example, sufficiently so to show magnetic attraction in a moderately strong field, but still to a degree much less undesirable than would be the case with a magnetic type of the metal, so that in this sense, the term "non-magnetic" must be regarded as somewhat relative, and intended to mean a material with minimal or very little normal magnetizable or ferromagnatic quality.

The guard bands, FIG. 6 and 7, may be of ordinary springy wire stock and are split to eliminate inductive effects, while permitting some spring action for snapping into the grooves. The much thinner bands of FIG. 8, of relatively non-magnetic stainless steel, being a continuous ring press fitted into position over the ends of the magnet, will exhibit slight but unobjectionable inductive effects insignificant in the larger sizes of magnet to which this form of the banding is suited; while either form will have the constraining effect necessary to eliminate a major part of the stoppages caused by magnet deformation complained of, arising, as it does, from the cracks and fissures which tend to develop almost entirely along axially oriented lines owing to unrelieved stresses set up about the inside diameters of such magnets. It has been found, for example, that magnets of the type described can fragment at the axial ends, beginning along a line close to the bore, and free a sizable chip, which is itself a magnet, but one which has an opposing polarity to the parent magnet at the fracture line, which adds to the danger because this opposing polarity then causes the chip to be forcibly deflected in a generally radial sense away from the break zone toward the air gap. The encasing jacket type of guard means (FIG. 1), in addition to sealing off the magnet from fluid contact, wholly eliminates all forms of jamming, deformation and fragmentation; but the individual band means is very nearly as effective because it guards against the results of the most frequent type of faulting —breaks creeping along the bore axially—as well as most chipping at the ends of the cylinder.

I claim:

1. In a magnetically coupled pump of the type having a rotary impeller and conjoined, driven, one-piece cylindrical coupling magnet with a longitudinal bore and formed of a magnetic composition of the frangible type susceptible to fracture and like faulting, and rotating coaxially with the impeller with its cylindrical surface closely confronting an enclosure wall portion located in a narrow clearance space subjoining said surface in the magnetic air gap between the magnet and a cooperative driving magnet rotated externally of said wall portion, the combination with said driven magnet of guard means comprising substantially non-magnetic circumambiently extending restrictive band means substantially encircling the magnet body in a direction about the cylindrical aspect thereof to confine at least portions thereof in case of fracture or faulting, as aforesaid, against dislocation in a direction particularly toward said clearance space, the outermost periphery of said band means lying close to the outer periphery of the magnet body well within said clearance space.

2. The combination of claim 1 wherein said band means embraces the entire cylindrical surface of the magnet body.

3. Apparatus according to claim 1 wherein said band means is metallic as well as substantially non-magnetic and continuous in the circumferential direction about the cylindrical aspect of the magnet body.

4. Apparatus according to claim 1 wherein said band means is metallic and interrupted in the circumferential direction about the cylindrical aspect of the magnet body.

5. The combination of claim 1 wherein said band means lies on the surface of the cylindrical periphery of the magnet body.

6. The combination of claim 1 wherein said band means lies substantially within circumambient grooved portions of the magnet body with an external peripheral portion thereof substantially flush with the outer cylindrical surface of said body.

7. The combination of claim 1 wherein said band means has the form of a cup-shaped jacket of metal having low magnetizable properties, the jacket having a thin cylindrical wall portion closely embracing the entire cylindrical surface of the magnet body, and a bottom wall fitting against an axial end of the body remote from said impeller.

8. The combination of claim 1 wherein said band means is a thin-walled jacket encasing the magnet body in its entirety and having low magnetizable properties.

9. The combination of claim 1 wherein said band means is a thin-walled jacket of non-metallic, non-magnetic, substantially rigid synthetic plastic material formed about the entire external aspects, at least, of the magnet body.

10. The combination of claim 1 wherein said band means comprises a plurality of uninterrupted ring-shaped members extending in a direction circumferentially about the cylindrical aspect of the magnet body and spaced apart along the axis of rotation thereof with at least one such member situated closely adjacent each of the axial end regions of said body.

11. The combination of claim 1 wherein said band means comprises a plurality of ring-shaped members each lying in a groove in the magnet body extending in a direction circumferentially about the cylindrical aspect thereof, there being one of said members situated closely adjacent each of the axial ends of said body.

12. The combination of claim 1 wherein said band means comprises a plurality of ring-shaped members of thin-walled metal having low magnetizable properties and each having a width substantially greater than the thickness thereof, the outermost periphery of each said member lying closer to the outer cylindrical periphery of the magnet than to said confronting wall portion so as to require no enlargement of the air gap for rotation wholly clear of said wall portion.

13. The combination of claim 1 wherein said band means is a thin-walled cylindrical sleeve forming an integral part of a cylinder-shaped plastic jacket embracing the magnet body with portions extending over at least a substantial portion of both axial end regions thereof and respectively integrally joining with said sleeve.

14. The combination of claim 1 wherein said band means constitutes a thin-walled cylindrical sleeve portion of a cylindrical jacket having integral portions covering all surfaces of the magnet body.

15. In a magnetically coupled pump having a rotary impeller and a magnet well in which a cylindrical coupling magnet attached to the impeller rotates with the cylinder axis in alignment with the axis of rotation of the impeller and the outer cylindrical periphery of the magnet rotating in a narrow clearance space confronting wall portions of said well, improvements comprising: a coupling magnet in attachment to the impeller as aforesaid and formed in one homogeneous piece as a cylindrical tube of a magnetic composition of the ceramic type including barium ferrite, and guard means embracing the cylindrical aspect of the magnet body at least along portions of the axial length thereof, and comprising effectively non-magnetic band means extending in a circumferential direction about the cylinder axis to substantially encircle said body within a predetermined peripheral boundary subjoining the outer cylindrical surface thereof so as to lie wholly within said clearance space and serving to confine fragmented portions of the magnet body resulting from fracture and faulting within the body against displacement into the clearance space.

16. The improvements defined in claim 15 further characterized in that said band means forms the cylindrical wall of an open-ended cylindrical cup of thin metal of low magnetizable properties, for example, non-magnetic stainless steel, said cup having a bottom wall and an adjoining cylindrical side wall of a diameter to fit snugly upon and about the entire outer cylindrical surface of said magnet body with said bottom wall confronting an axial end of said body.

17. The structure of claim 16 wherein said axial end of the magnet body is the distal end relative to the impeller, and the axial end of the magnet body proximate to the impeller is sealed by a cementitious material interposed between said axial end and a juxtaposed axial portion of the impeller.

18. In a centrifugal pump having an impeller with a driven coupling magnet sealed within a pump housing to rotate under the influence of an externally rotating driving magnet, the improvements which comprise: sealing the driven magnet against fragmentation and chemical attack by means of a thin-walled plastic shell enveloping the external surfaces of the magnet and providing said impeller with an axial hub extension at one axial side thereof, the annular bore of the driven magnet being tightly fitted upon said extension with an axial end wall portion thereof closely juxtaposed to said axial side of the impeller wherein said juxtaposed side and wall portion are provided with complementary interengaging formations keying the impeller and magnet against relative rotative displacement.

* * * * *